US011589447B2

(12) United States Patent
Yang et al.

(10) Patent No.: US 11,589,447 B2
(45) Date of Patent: Feb. 21, 2023

(54) DRIVING DEVICE FOR DRIVING A HIGH-VOLTAGE X RAY TUBE AND METHOD THEREOF DRIVING THE SAME

(71) Applicant: ENERGY RESOURCES INTERNATIONAL CO., LTD., New Taipei (TW)

(72) Inventors: Tsung-Min Yang, New Taipei (TW); Hung-Chiang Huang, New Taipei (TW)

(73) Assignee: ENERGY RESOURCES INTERNATIONAL CO., LTD., New Taipei (TW)

( * ) Notice: Subject to any disclaimer, the term of this patent is extended or adjusted under 35 U.S.C. 154(b) by 0 days.

(21) Appl. No.: 17/224,605

(22) Filed: Apr. 7, 2021

(65) Prior Publication Data

US 2022/0330412 A1 Oct. 13, 2022

(51) Int. Cl.

*H05G 1/20* (2006.01)
*H05G 1/54* (2006.01)
*H05G 1/32* (2006.01)

(52) U.S. Cl.

CPC ..... *H05G 1/20* (2013.01); *H05G 1/32* (2013.01); *H05G 1/54* (2013.01)

(58) Field of Classification Search

CPC ..... H05G 1/20; H05G 1/32; H05G 1/54
See application file for complete search history.

(56) References Cited

U.S. PATENT DOCUMENTS 2,840,718 A * 6/1958 Wright ..... H05G 1/46 378/118
5,077,771 A * 12/1991 Skillicorn ..... H05G 1/06 378/102
2017/0049409 A1* 2/2017 Oh ..... H05G 1/10

FOREIGN PATENT DOCUMENTS

JP 2003142294 A * 5/2003 ..... H05G 1/10

* cited by examiner

*Primary Examiner* — Chih-Cheng Kao
(74) *Attorney, Agent, or Firm* — Muncy, Geissler, Olds & Lowe, P.C.

(57) ABSTRACT

A method and a device for driving high-voltage X ray tube with positive and negative pulses are disclosed comprises a microprocessor unit having a first output port and a second output port, respectively outputting a first and a second timing sequence of control signals, a high-voltage X ray tube, a first high-frequency voltage boost circuit outputting a first regulated high-voltage, a first high-voltage protection circuit, a second high-frequency voltage boost circuit outputting a second high-voltage, and a second high-voltage protection circuit. The first high and the second voltages are respectively, regulated by the first timing sequence of control signal and the second timing sequence of control signal. Both regulated high-voltages are, respectively, inputted to anode and cathode of the high-voltage X ray tube vias the high-voltage protected circuits.

7 Claims, 7 Drawing Sheets

DRIVING DEVICE FOR DRIVING A HIGH-VOLTAGE X RAY TUBE AND METHOD THEREOF DRIVING THE SAME

FIELD OF THE INVENTION

The present invention pertains to a high-voltage X ray tube, particularly to a device for driving the same and for eliminating the residual gases and impurities inside the same while manufacture.

DESCRIPTION OF THE PRIOR ART

According to a conventional method, as is shown in FIG. 1, a high-voltage switch 100 connects the anode 150A of the high-voltage X ray tube 150 and the high-voltage power supply 120. A pulse generating circuit 140 generates a single pulse P to control the high-voltage switch 100. Thus, the power of the high-voltage X ray tube 150 is provided with a unipolar high-voltage output. Usually, the high-voltage switch 100 is expensive, and is, even, difficult to get.

An article "Reduced EMI by driving high power LEDs" issued in American EDN electronic journal in 2018, disclosed that a threshold voltage of the LED is first applied to the high-power LED module, and then a low voltage switch is used to introduce a large voltage to drive the LED. The threshold voltage is used to reduce switching noise due to reduce the boost amplitude during voltage switching. However, the high-voltage switch or threshold voltage driving method is still insufficient for applying to a device which requires a voltage up to tens of thousands of volts.

In view of the prior art issues, the present invention provides a driving device and a method thereof to carry out residual gases and impurities removal inside the Xray tube during vacuuming the high-voltage X ray tube and apply to drive the same.

An object of the present invention is to disclose a lower cost driving device for driving a high-voltage X ray tube and for performing residual gases and impurities removal than that of aforesaid conventional prior art since the present invention use a technique of bipolar regulated high-voltage pulses exerted on the anode and the cathode of the high-voltage X ray tube rather than unipolar high voltage exerted on the anode of the high-voltage X ray tube.

Another object of the present invention is to disclose a driving device for driving a high-voltage X ray tube. The driving device uses bipolar regulated high-voltage pulses exerted on the anode and the cathode of the high-voltage X ray tube to perform residual gases and impurities removal.

According to the first preferred embodiment, a driving device for driving a high-voltage X ray tube comprises a microprocessor unit having a first output port and a second output port using a predetermined timing sequence to output a first timing sequence of control signal and a second timing sequence of control signal; a first high-frequency voltage boost circuit connecting the first output port to output first regulated positive voltage pulses by the first timing sequence of control signal; a second high-frequency voltage boost circuit connecting the second output port to output second regulated negative voltage pulses by the second timing sequence of control signal which has a pulse width T2; a first high-voltage protective circuit connecting an anode of the high-voltage X ray tube and an output terminal of said first high frequency voltage boost circuit; a second high-voltage protective circuit connecting a cathode of the high-voltage X ray tube and an output terminal of said second high-frequency voltage boost circuit.

Wherein the second timing sequence of control signal has a negative pulse width of T2, and the first timing sequence of control signal has delay time length of T3 and T4 and n-piece of positive pulses and each of the positive pulse has a periodic time T1 and within the pulse width of T2, satisfying equations of T2=T3+n*T1+T4, and T1=ta+tb.

According to the second preferred embodiment, a driving device for driving a high-voltage X ray tube, comprises a microprocessor unit having a first output port and a second output port using a predetermined timing sequence to output a first timing sequence of control signal and a second timing sequence of control signal; a first high-frequency voltage boost circuit connecting the second output port to output second regulated positive voltage pulses having a pulse width of T2 each by the second timing sequence of control signal; a second high-frequency voltage boost circuit connecting the first output port to output first regulated negative voltage pulses with a periodic time T1 in each by the first timing sequence of control signal, and within the pulse width of T2, satisfying an equation of T2=T3+n*T1+T4, wherein both said T3 and T4 are delay time length; a first high-voltage protective circuit connecting an anode of the high-voltage X ray tube and an output terminal of the first high frequency voltage boost circuit; a second high-voltage protective circuit connecting a cathode of the high-voltage X ray tube and an output terminal of the second high-frequency voltage boost circuit.

According to a modified embodiment of the first preferred embodiment, the first timing sequence of control signal outputted by a first output port is used to control a first high-voltage switch. The first high-voltage switch connects the output terminal of the first high-frequency voltage boost circuit to an anode of the high-voltage X ray tube and the first high-voltage protective circuit. The second timing sequence of control signal outputted by the second output port is used to control a second high-voltage switch. The second high-voltage switch connects the output terminal of the second high-frequency voltage boost circuit to a cathode of the high-voltage X ray tube and the second high-voltage protective circuit.

DESCRIPTION OF THE PREFERRED EMBODIMENT

The present invention provides a driving device and method thereof for driving a high-voltage X ray tube by positive and negative regulated high-voltage pulses exerted on the corresponding electrodes to eliminate residual side and impurities in the X ray tube.

Figure 1:
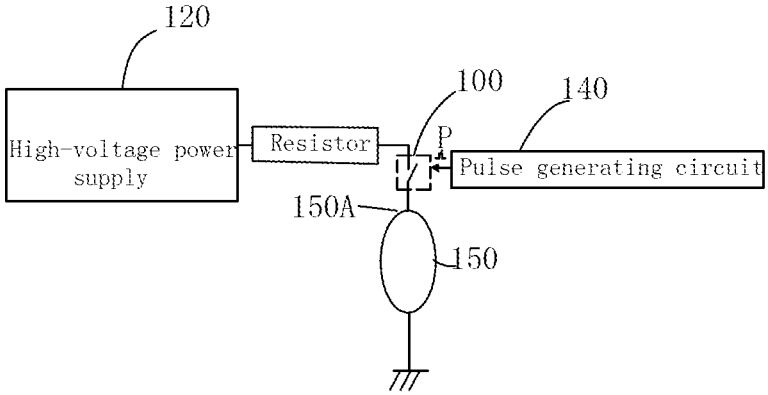
FIG. 1 illustrates a diagram which a high-voltage pulse exerted on single electrode of the X ray tube in accordance with the prior art.
Figure 2:
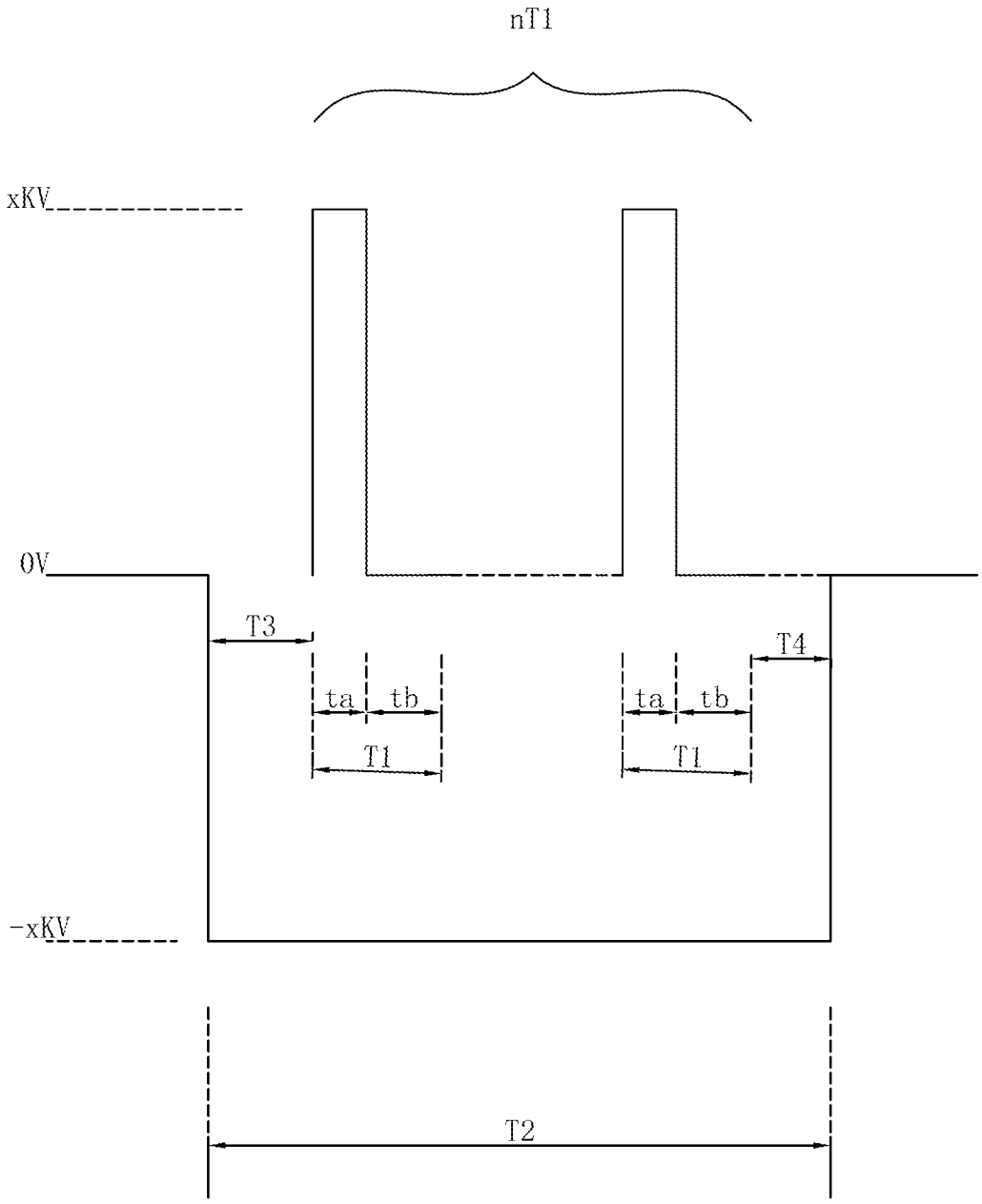
FIG. 2 illustrates a diagram which the timing waveforms have 2xKV voltage difference exerted on the anode and cathode of the X ray tube, respectively, in accordance with the first preferred embodiment of the present invention.

Referring to FIG. 2, it shows a timing waveform diagram with a high-voltage difference of 2xkV applying on the anode and cathode 150C of the high-voltage X ray tube 150 according to the first preferred embodiment of the present invention. Please also refer to FIG. 5, the negative square wave applied to the cathode of the high-voltage X ray tube 150 is a negative square wave with peak level by −xkV and with a pulse width of T2. Meanwhile, within pulse width of T2, there are n-piece of positive pulses each with a periodic time of T1 exerted on the anode 150A of the high-voltage X ray tube 150. The periodic time of T1 of a positive pulse consists of a voltage level of xkV in a pule width of ta, and a voltage value of 0 V or a low voltage level in a time length of tb. After a left edge of the negative voltage level −xkV falling and delaying a T3 time length, n-piece of the first positive pulse with the periodic time of T1 is successively followed. After the right edge of the nth positive pulse falling and then waiting a delay time length of T4, the right edge of the negative pulse rises.

Figure 3:
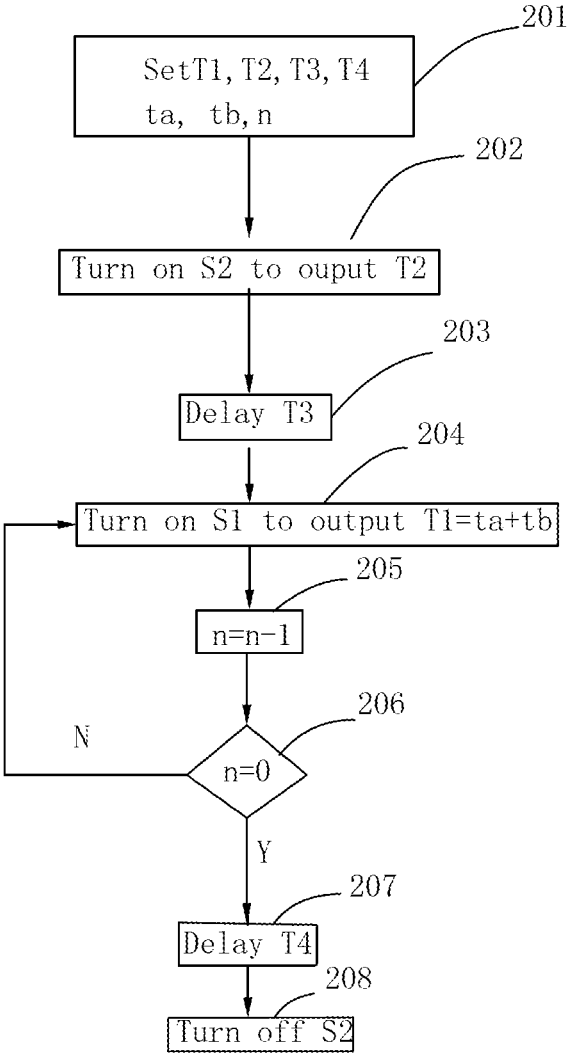
FIG. 3 illustrates a flow chart for generating the timing waveforms shown in the FIG. 2.

FIG. 3 shows a flowchart for generating the above-mentioned timing sequence pulses. First, as shown in a step 201, set the waveform time parameters such as T1, T2, T3, T4, ta, tb and the number n. In a step 202, then, turn on the output port S2 to output a pulse with a pulse width of T2, then, in a step 203, delay a time length T3; then, in a step 204, turn on the output port S1 to output T1 where T1+ta+tb; then, as in a step 205 set n=n−1; Next, in a step 206, judge whether n=0; if it is, in a step 207, after the delay time of T4, turn off the output port S2, as in a step 208; if the determined result of the step 206 is "no," continue to output positive pulse, each with the periodic time T1, go back to the step 204. The value of the above parameter n depends on the type of the high-voltage X ray tube 150 and the vacuum status inside.

Figure 4:
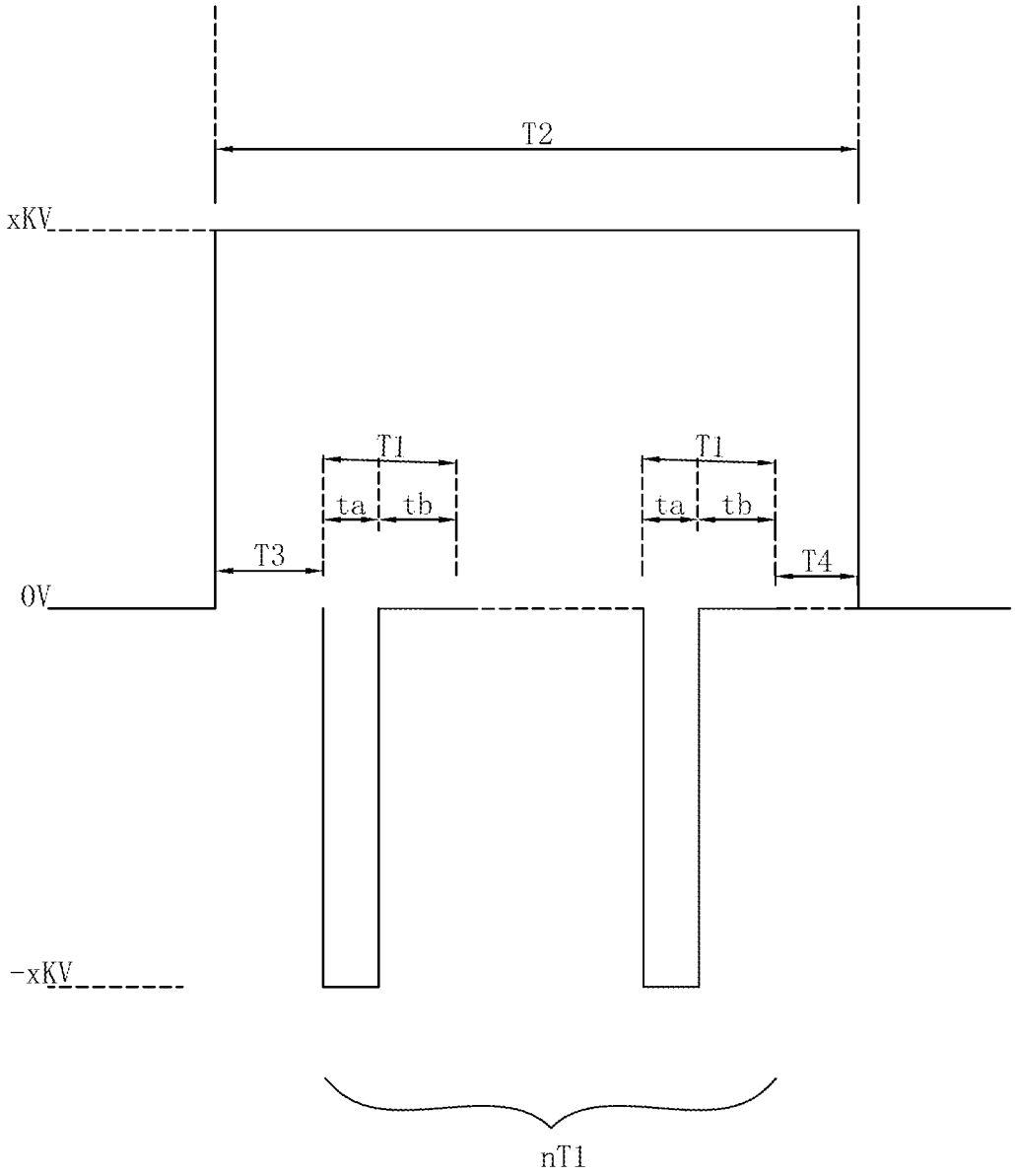
FIG. 4 illustrates a diagram which the timing waveforms have 2xKV voltage difference exerted on the anode and cathode of the X ray tube, respectively, in accordance with the second preferred embodiment of the present invention.

According to a second preferred embodiment of the present invention, the second output port S2 outputs positive pulses with a pulse width T2 in each and the first output port S1 outputs negative pulses with a periodic time of T1 in each. FIG. 4 illustrates such a timing waveform diagram, in this situation, the equation of T2=T3+n*T1+T4, is still established.

Figure 5:
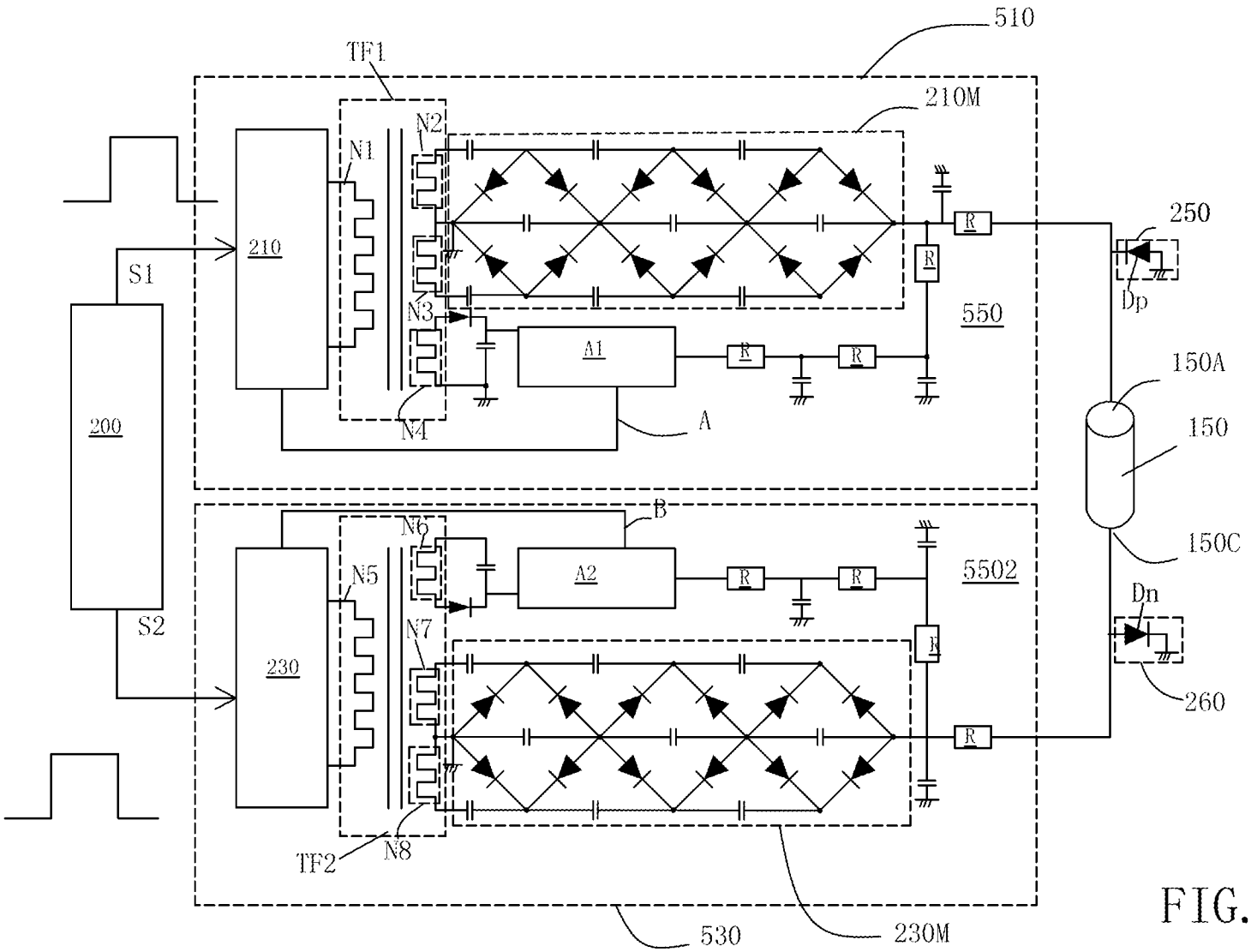
FIG. 5 illustrates a circuit block diagram thereof for eliminating residual gases and impurities inside an X ray tube and for generating the waveforms shown in FIG. 2, according to the first preferred embodiment of the present invention.

FIG. 5 shows a circuit block diagram thereof for eliminating residual gases and impurities in an X ray tube according to the first preferred embodiment of the present invention. The circuit blocks for driving an anode 150A and a cathode 150C of the X ray tube are inputted with a first regulated positive voltage pulses and second regulated negative voltage pulses. The circuit blocks comprise a microprocessor unit 200, a first high-frequency voltage boost circuit 510, a second high-frequency voltage boost circuit 530, a first high-voltage protection circuit 250, a second high-voltage protection circuit 260, and a high-voltage X ray tube 150. Wherein, the microprocessor unit 200 includes the first output port S1 and the second output port S2, respectively outputting a first timing sequence of control signal and a second timing sequence of control signal in accordance with a predetermined timing program. The first output port S1 is connected to the first high-frequency voltage boost circuit 510 using the first timing sequence of control signal to output first regulated positive voltage pulses. The first regulated positive voltage pulses include a delay time length T3, following with n-pieces of positive high voltage pulses, each with a periodic time T1, and a delay length T4. In every periodic time T1, there is a voltage level xkV in a time length of to and a 0-voltage level with a time length of tb.

The second output port S2 is connected to the second high-frequency voltage boost circuit 530 using the second timing sequence of control signal to output second regulated negative high-voltage pulses, and each second regulated negative high-voltage pulse has a pulse width T2 and a voltage level of −xkV.

According to the first preferred embodiment, within the pulse width of T2, an equation of T2=T3+n*T1+T4 is established.

Still referring to FIG. 5, a first high-voltage protection circuit 250 is connected the anode 150 of the high-voltage X ray tube 150 and the output terminal of the first high-frequency voltage boost circuit 510. The second high-voltage protection circuit 260 is connected the cathode 150C of the high-voltage X ray tube 150 and the output terminal of the second high-frequency voltage boost circuit 530.

Therefore, the positive high-voltage pulses regulated by the first timing sequence of control signal and the negative high-voltage pulses regulated by the second timing sequence of control signal are respectively inputted to the anode 150A and the cathode 150C of the high-voltage X ray tube 150 in accordance with the timing voltage waveform shown in FIG. 2 to eliminate the residual gases and impurities therein.

The first high-frequency boost circuit 510 includes a first high frequency f1 basic voltage switch circuit module 210, a first transformer TF1, a first voltage boost module 210M, and a comparison feedback circuit 550. The first transformer TF1 includes a primary coil N1 and three secondary coils which are respectively N2, N3, and N4. Among them, one end of the secondary coils N2, N3, and N4 is grounded, and the other end of the secondary coils N2, N3 is then through a capacitor connected to two anodes of the two diodes of the first voltage boost module 210M, as is shown in the FIG. 5. The first voltage boost module 210M is composed of a plurality of diodes and capacitors, which the capacitor each is as the bridge of the diodes of the multiple voltages circuit. The other end of the secondary coil N4 is connected to a comparison feedback circuit 550. The comparison feedback circuit 550 is connected to the first voltage boost module 210M. The comparison feedback circuit 550 includes a first loop, an error-correction amplification A1, and several second loops in series successively connected. The first loop consists of a diode and one end grounded capacitor, and the other end of the capacitor in series with the error-correction amplification A1. The second loops each consists of a resistor and a one-end grounded capacitor. An optical fiber "A" is then connected the error-correction amplification A1 with the first high-frequency f1 basic voltage switch circuit module 210 to correct the pulses outputted from the first high-frequency f1 basic voltage switch circuit module 210. The anode of the high-voltage diode Dp of the first protection circuit 250 is grounded and the cathode of the high-voltage diodes Dp is connected to the anode 150A of the high-voltage X ray tube 150.

Still referring to FIG. 5, the second high-frequency boost circuit 530 includes a second transformer TF2, a second voltage boost module 230M, and a second comparison feedback circuit 5502. The second transformer TF2 includes a primary coil N5 and three secondary coils which are respectively N6, N7, and N8. Among them, one end of the secondary coils N6, N7, and N8 is grounded, and the other end of the secondary coils N6, N7 is then through a capacitor connected to two cathodes of the diodes of a second voltage boost module 230M, as is shown in the FIG. 5. The second voltage boost module 230M is composed of a plurality of diodes and capacitors, which the capacitor each is as the bridge between the diodes of the cascade voltage multiplier circuit. The other end of the secondary coil N6 is connected to a second comparison feedback circuit 5502. The second comparison feedback circuit 5502 is connected to the second voltage boost module 230M. The second comparison feedback circuit 5502 includes a first loop, an error-correction amplification A2, and several second loops in series successively connected. The first loop consists of a diode and one end grounded capacitor, the other end of the capacitor in series with the error-correction amplification A2. The second loops each consists of a resistor and one end grounded capacitor. An optical fiber "B" is then connected the error-correction amplification A2 with the second high-frequency f2 basic voltage switch circuit module 230 to the correct the pulses outputted from the first high-frequency f2 basic voltage switch circuit module 230. The cathode of the high-voltage diode Dn of the second protection circuit 260 is grounded and the anode of the high-voltage diode Dn is connected to the cathode 150C.

The breakdown voltage of the high-voltage diode Dp is required to be higher than the first regulated positive voltage pulses and the breakdown voltage of the high-voltage diode Dn is required to be higher than the second regulated negative high-voltage. The high-voltage diode Dp and Dn can also be enhanced by using a plurality of the high-voltage diodes connected in series.

Figure 6:
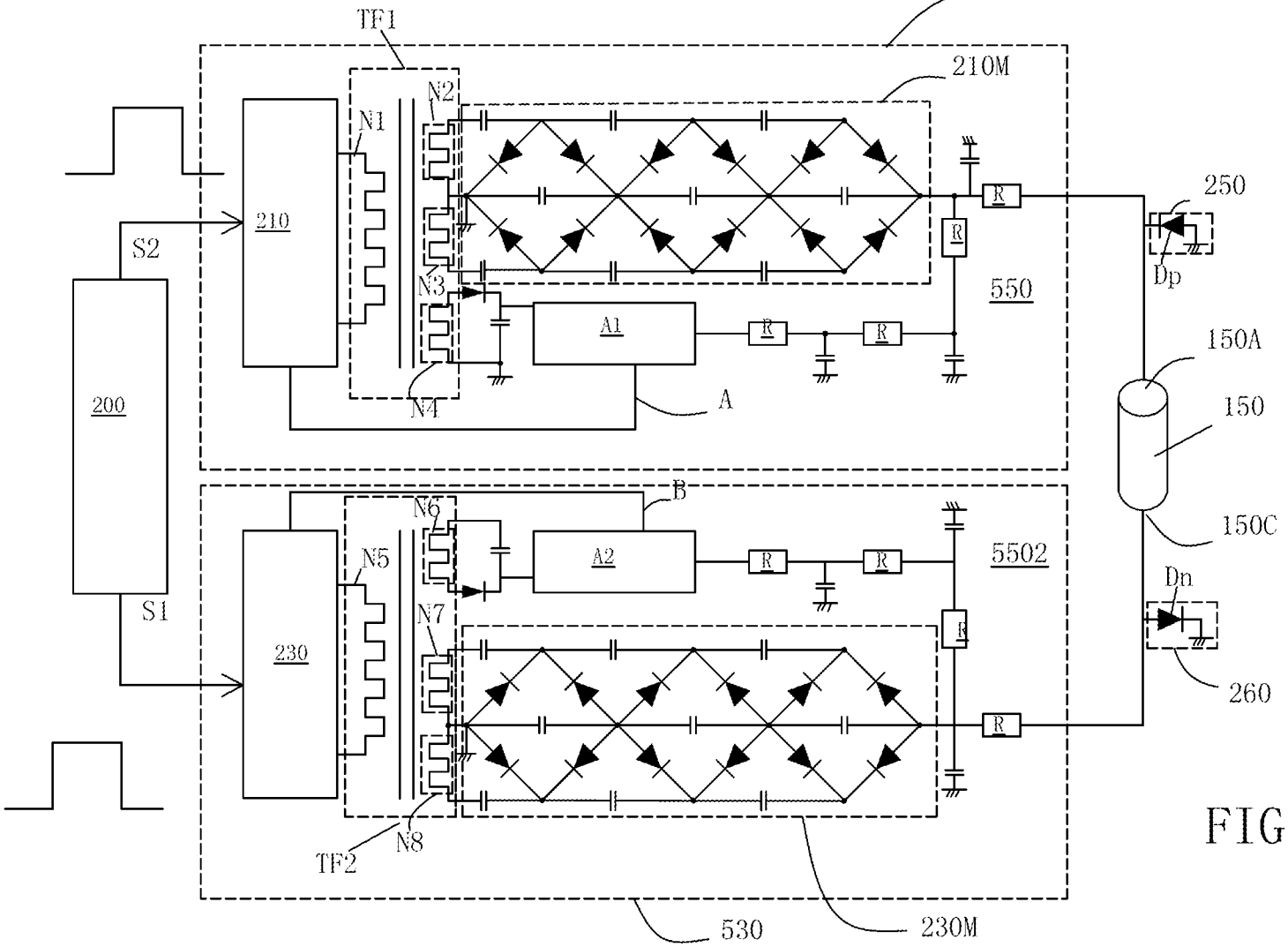
FIG. 6 illustrates a circuit block diagram thereof for generating waveforms illustrating in FIG. 4 and for eliminating residual gases and impurities inside an X ray tube according to the second preferred embodiment of the present invention.

FIG. 6 shows a circuit block diagram according to the second preferred embodiment of the present invention for generating the waveforms shown in the FIG. 4. In comparison with the first preferred embodiment, the second preferred embodiment has the same circuit blocks except the positions of the first output port S1 and the second output port S2 are mutually swapped. That is the second output port S2 is connected to the first high frequency f1 basic voltage switch circuit module 210 of the first high-frequency voltage boost circuit 510 and the first output port S1 of the microprocessor unit is connected to the second high frequency f2 basic voltage switch circuit module 230 of the second high-frequency voltage boost circuit 530. The first high-frequency voltage boost circuit 510 output second regulated positive voltage pulses, each with pulse width of T2 and the second high-frequency voltage boost circuit 530 outputs first regulated negative voltage pulses with a periodic time T1 in each negative voltage pulse.

Figure 7:
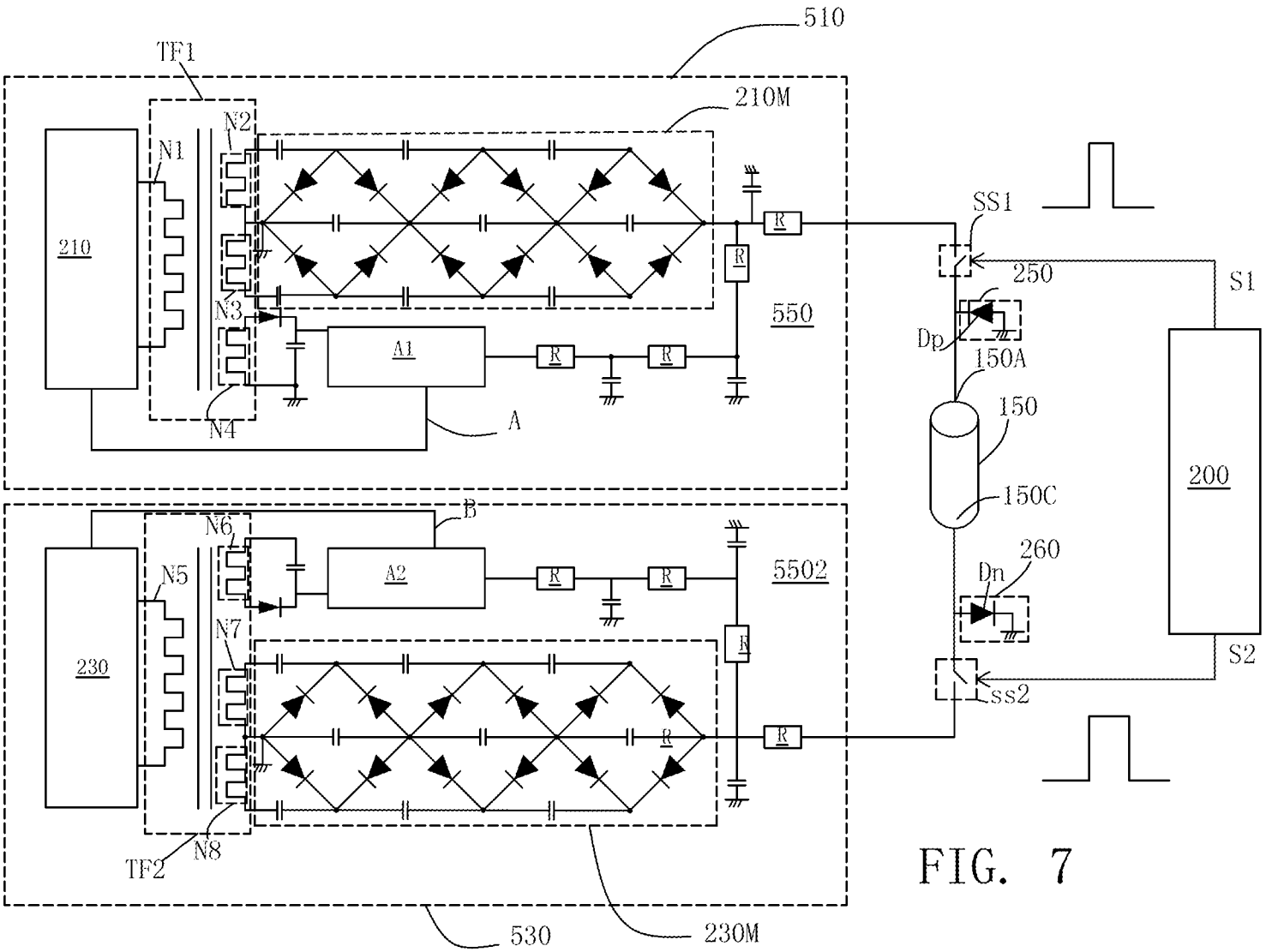
FIG. 7 illustrates a circuit block diagram of a modified embodiment according to the first preferred embodiment of the present invention.

FIG. 7 shows a circuit block diagram of a modified embodiment according to the first preferred embodiment for generating the waveforms shown in FIG. 2. In comparison with the first preferred embodiment, it can be found that the two have similar circuit blocks, except the first and the second timing sequence control signals are implanted to positions after the output terminals of the first voltage boost module 210M and second voltage boost module 230M. Therefore, driving device for driving the high-voltage X ray tube includes: a first high-frequency voltage boost circuit 510, which outputs a positive high-voltage pulses with a frequency of f1; a second high-frequency voltage boost circuit 530, which outputs a negative high-voltage pulses with a frequency of f2, a microprocessor unit 200 having a first output port S1 and a second output port S2, a first high-voltage switch SS1 controlled by the first timing sequence control signal outputted by the first output port S1 to regulate the voltage pulses from the first high-frequency voltage boost circuit 510, the first high-voltage switch SS1 connected the output terminal of the first high frequency boost circuit 510 to a first high-voltage protective circuit 250 and an anode 150A of the high voltage X ray tube, a second high-voltage switch SS2 controlled by the second timing sequence control signal outputted by the second output port S2 to regulated the output voltage pulse of the second high frequency boost circuit 530, the second high-voltage switch SS2 connected the output terminal of the second high frequency boost circuit 530 to the second high-voltage protective circuit 260 and a cathode 150C of the high voltage X ray tube. Therefore, by means of the regulated voltage pulses from the first high-frequency voltage boost circuit 510, and from the second high-frequency voltage boost circuit 510, the regulated voltage pulses exerted on the anode 150A and cathode 150C, the residual gases and impurities eliminated inside the high-voltage X ray tube can be implemented.

In addition, according to the study of the present invention. The absolute difference between the working frequency f1 of the and the working frequency f2 higher than 10 kHZ, i.e., $|f1-f2|\leq 10$ kHz. is preferred to reduce the electromagnetic interference.

The aforesaid embodiment, the absolute value of the voltage levels for positive pulse and the negative pulse are assume the same. The person whoever skilled in the art understand they are for exemplary convenience only, they may have difference, such as xKV vs. −ykV.

The benefits of the present invention are:

(1). The breakdown voltage of a high-voltage diode required is lower than that of the conventional art since the breakdown voltage is shared by two high-voltage protective circuits in accordance with the present invention. Thus, it can significantly cost down in views of the cost spent. Since the price of a high-voltage diode is not proportional soring with the value of the breakdown voltage but may several times high while the breakdown voltage of the high-voltage diode is required doubly.

(2). The timing sequence control signals are generated by two ports of the microprocessor can reduce the arc discharge effect and pulse width or periodic time of the timing sequence control signals can be easily adjusted according to the types of the high-voltage X ray tubes.

(3). The high-voltage switches can be skipped out in the hardware circuit to implement the residual gases and impurities elimination according to first preferred embodiment since the timing sequence control signals is inputted into the high frequency voltage boost circuit.

As is understood by a person skilled in the art, the foregoing preferred embodiments of the present invention are illustrated of the present invention rather than limiting of the present invention. It is intended to cover various modifications and similar arrangements included within the spirit and scope of the appended claims, the scope of which should be accorded the broadest interpretation to encompass all such modifications and similar structures.

What is claimed is:

1. A driving device for driving a high-voltage X ray tube, comprising:

a microprocessor unit having a first output port and a second output port using a predetermined timing sequence to output a first timing sequence of control signal and a second timing sequence of control signal;

a first high-frequency voltage boost circuit connecting said first output port to output first regulated positive voltage pulses by said first timing sequence of control signal;

a second high-frequency voltage boost circuit connecting said second output port to output second regulated negative voltage pulses by said second timing sequence of control signal;

a first high-voltage protective circuit connecting an anode of the high-voltage X ray tube and an output terminal of said first high frequency voltage boost circuit;

a second high-voltage protective circuit connecting a cathode of the high-voltage X ray tube and an output terminal of said second high-frequency voltage boost circuit; and whereby removal of residual gases and impurities in the high-voltage X ray tube during vacuuming and the driving of the high-voltage X ray tube are carried out by said first regulated positive voltage pulses and said second regulated negative voltage pulses, respectively, exerted on said anode and said cathode of said high-voltage X ray tube.

2. The driving device for driving a high-voltage X ray tube according to the claim 1, wherein said second timing sequence of control signal has a pulse width of T2 with a negative voltage and said first timing sequence of control signal has delay time of T3 and T4 and n-piece of positive pulses, n as a positive integer and each said positive pulse has a periodic time T1 within said pulse width of T2, satisfying an equation of T2=T3+n*T1+T4.

3. The driving device for driving a high-voltage X ray tube according to the claim 1, wherein said first high-frequency voltage boost circuit has a working frequency f1 and said second high-frequency voltage boost circuit has a working frequency f2 and satisfies the equation of |f1−f2|>10 kHz.

4. The driving device for driving a high-voltage X ray tube according to the claim 1, wherein said first high-voltage protective circuit has a first high-voltage diode with an anode grounded and a cathode thereof connecting to the anode of the high-voltage X ray tube and a breakdown voltage of said first high-voltage diode is higher than the first regulated positive voltage pulses and said second high-voltage protective circuit has a second high-voltage diode with a cathode grounded and an anode thereof connecting to the cathode of the high-voltage X ray tube and a breakdown voltage of said second high-voltage diode is higher than the second regulated negative voltage pulses.

5. A method of driving a high-voltage X ray tube using the driving device according to claim 1, comprising the steps of:

setting parameters T3, n, T1, ta, tb, T4 of said first timing sequence of control signal and parameter T2 of said second timing sequence of control signal wherein said T3 and T4 are delay time length and n is a positive integer number, and said T1 is a periodic time of positive pulse, and T2 is a periodic time of a negative pulse width T2;

turning on said second output port to output said negative pulse width T2;

waiting said delay time length T3;

turning on said first output port to output n-piece of positive pulses, and each with said periodic time T1;

waiting said delay time length T4; and turning off said first output port and said second output port.

6. A driving device for driving a high-voltage X ray tube, comprising:

a microprocessor unit having a first output port and a second output port using a predetermined timing sequence to output a first timing sequence of control signal and a second timing sequence of control signal;

a first high-frequency voltage boost circuit connecting said second output port to output second regulated positive voltage pulses, each of said second regulated positive voltage pulses with a pulse width of T2 by said second timing sequence of control signal in accordance with said predetermined timing sequence;

a second high-frequency voltage boost circuit connecting said first output port to output first regulated negative voltage pulses with a periodic time T1 in each by said first timing sequence of control signal in accordance with said predetermined timing sequence, and within said pulse width of T2, satisfying an equation of T2=T3+n*T1+T4, wherein both said T3 and T4 are delay time length, and n is a positive integer number;

a first high-voltage protective circuit connecting an anode of the high-voltage X ray tube and an output terminal of said first high frequency voltage boost circuit;

a second high-voltage protective circuit connecting a cathode of the high-voltage X ray tube and an output terminal of said second high-frequency voltage boost circuit; and whereby removal of residual gases and impurities in the high-voltage X ray tube during vacuuming and the driving of the high-voltage X ray tube are carried out by said second regulated positive voltage pulses and said first regulated negative voltage pulses, respectively, exerted on said anode and said cathode of said high-voltage X ray tube.

7. The driving device for driving a high-voltage X ray tube according to the claim 6, wherein said first high-frequency voltage boost circuit has a working frequency f1 and said second high-frequency voltage boost circuit has a working frequency f2 and satisfies an equation of |f1−f2|>10 kHz.

* * * * *